US007313988B2

(12) United States Patent
Williams et al.

(10) Patent No.: US 7,313,988 B2
(45) Date of Patent: Jan. 1, 2008

(54) TIE ROD REMOVAL AND INSTALLATION TOOL

(75) Inventors: Danny L. Williams, Clarinda, IA (US); Eduardo Llamas Montes, Colima (MX)

(73) Assignee: Lisle Corporation, Clarinda, IA (US)

( * ) Notice: Subject to any disclaimer, the term of this patent is extended or adjusted under 35 U.S.C. 154(b) by 0 days.

(21) Appl. No.: 11/407,667

(22) Filed: Apr. 20, 2006

(65) Prior Publication Data

US 2007/0245859 A1 Oct. 25, 2007

(51) Int. Cl.
*B25B 13/06* (2006.01)

(52) U.S. Cl. ..... 81/125; 125/124.1; 125/177.1; 125/177.85

(58) Field of Classification Search ..... 81/124.1, 81/124.2, 124.3, 124.4, 124.5, 124.6, 125, 81/177.1, 177.2, 177.85
See application file for complete search history.

(56) References Cited

U.S. PATENT DOCUMENTS 1,596,708 A * 8/1926 Bellows ..... 81/124.6
5,035,162 A * 7/1991 Dougherty ..... 81/124.4
5,101,695 A * 4/1992 Johnson ..... 81/124.6
5,123,310 A * 6/1992 McManus ..... 81/125
5,287,776 A 2/1994 Williams et al.
5,666,724 A * 9/1997 Kolsun ..... 29/888.02
5,924,343 A * 7/1999 Bogni et al. ..... 81/125

OTHER PUBLICATIONS

Progressive Engineering, Inner Tie Rod Tool, No. P6000-1, http://www.sjdiscounttools.com/prgp6000-1.html, Dec. 16, 2005.
Invention Disclosure Agreement dated Feb. 19, 2004, Eduardo Llamas Montes, "Inner Tie Rod Tool II".
Invention Disclosure Agreement dated Jul. 6, 2003, Theadore C. Nash, "Non-Wrench Flat Inner Tie Rod Tool".
Invention Disclosure Agreement dated Jun. 10, 1994, C. Wayne Gloe, "Universal Tie Rod End Socket".
Letter from Litman, McMahon and Brown dated Nov. 17, 1989 regarding Williams Specialty Tools, "Inner Tie Rod Service Tool".

* cited by examiner

*Primary Examiner*—Joseph J. Hail, III
*Assistant Examiner*—Anthony Ojini
(74) *Attorney, Agent, or Firm*—Banner & Witcoff, Ltd

(57) ABSTRACT

A tool for removal of inner tie rods having a generally cylindrical end includes a hollow tube with a butt plate at one end and an annular collar at the opposite end for attachment to the tie rod by means of three set screws arranged within an angular range of approximately 90°, wherein the tool collar is designed to provide for ease of assembly of the tool by joining the tube to the annular collar.

3 Claims, 2 Drawing Sheets

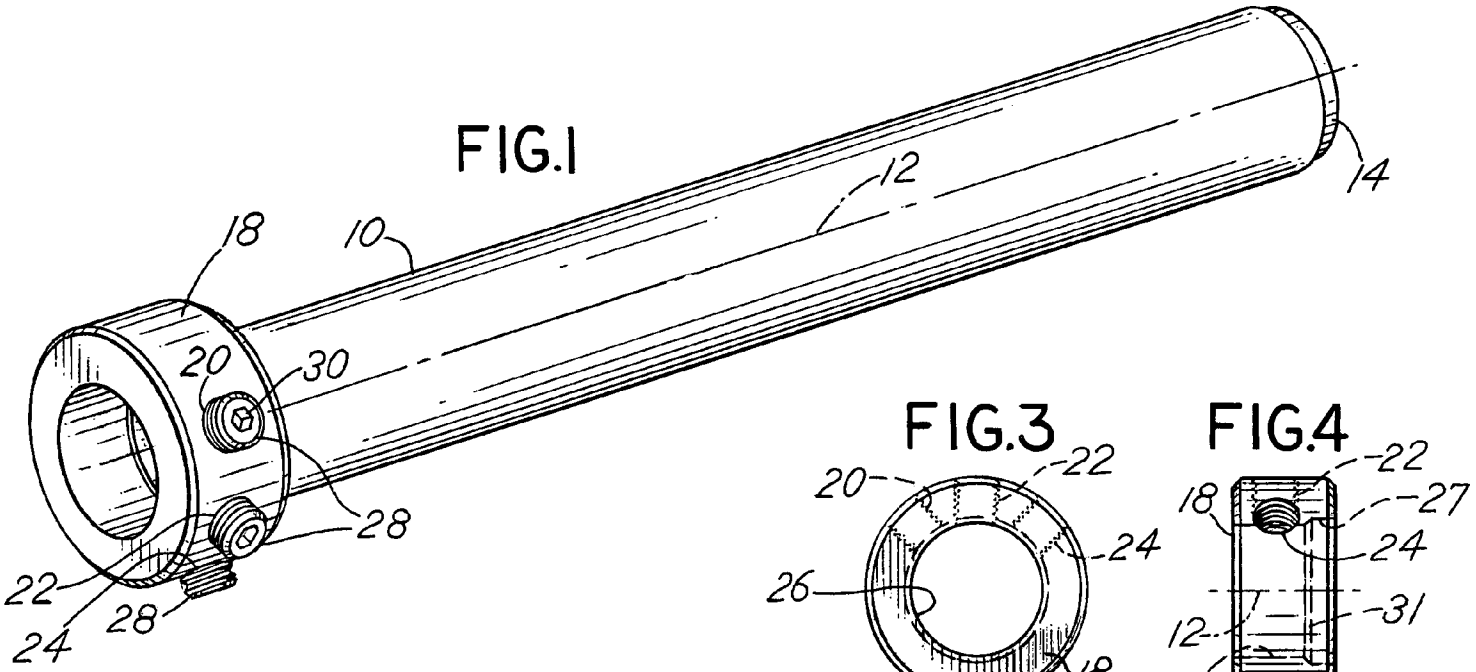
FIG.1
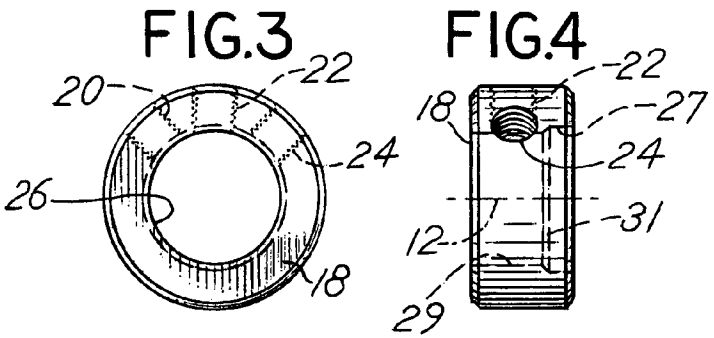
FIG.3
FIG.4
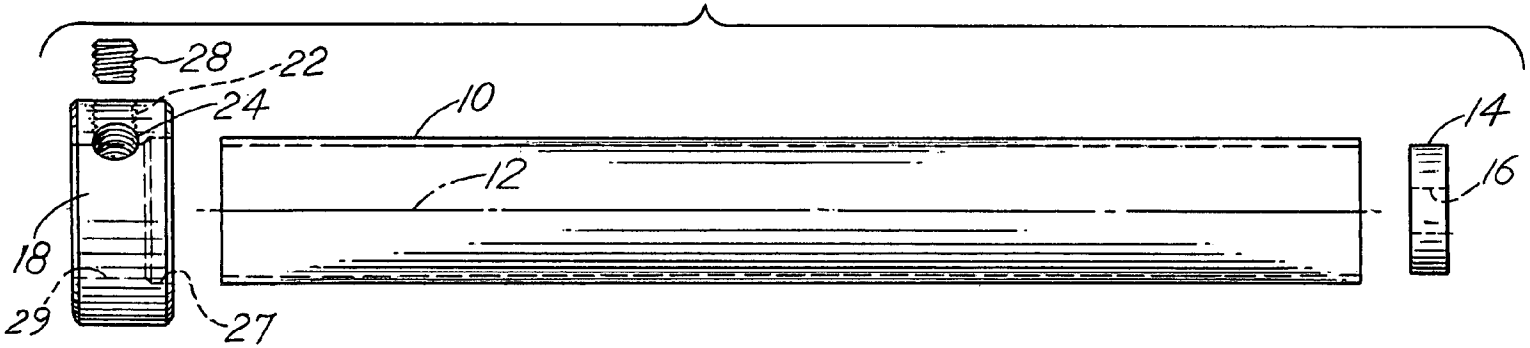
FIG.2

FIG.6
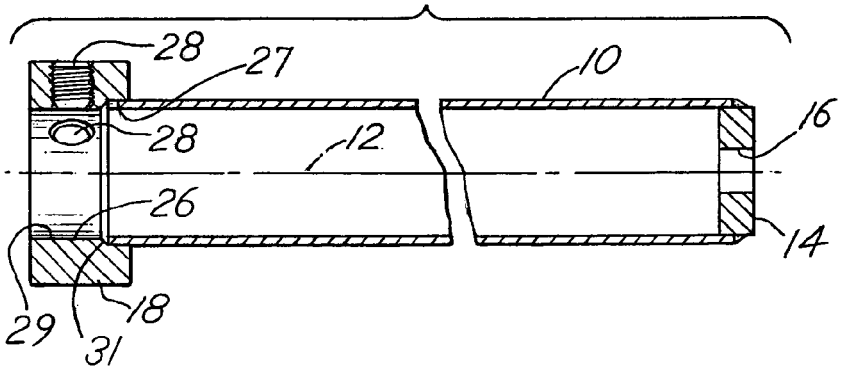
FIG.5
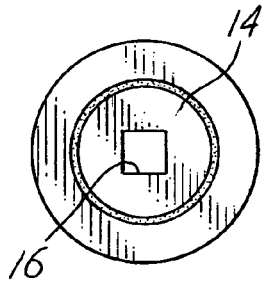
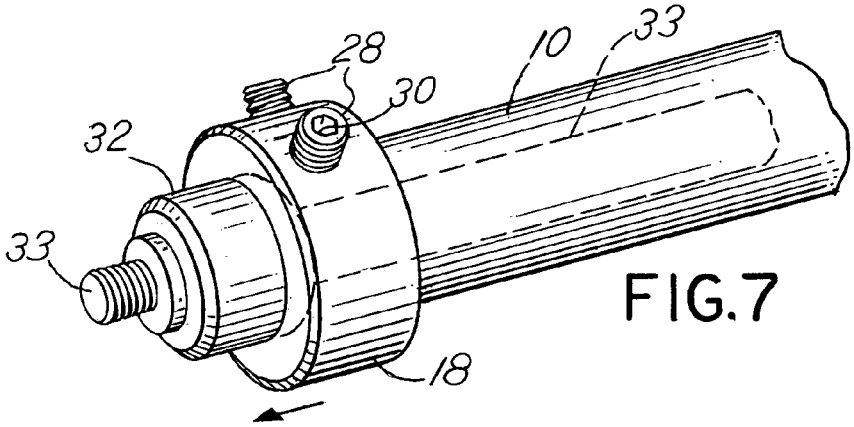
FIG.7
FIG.8
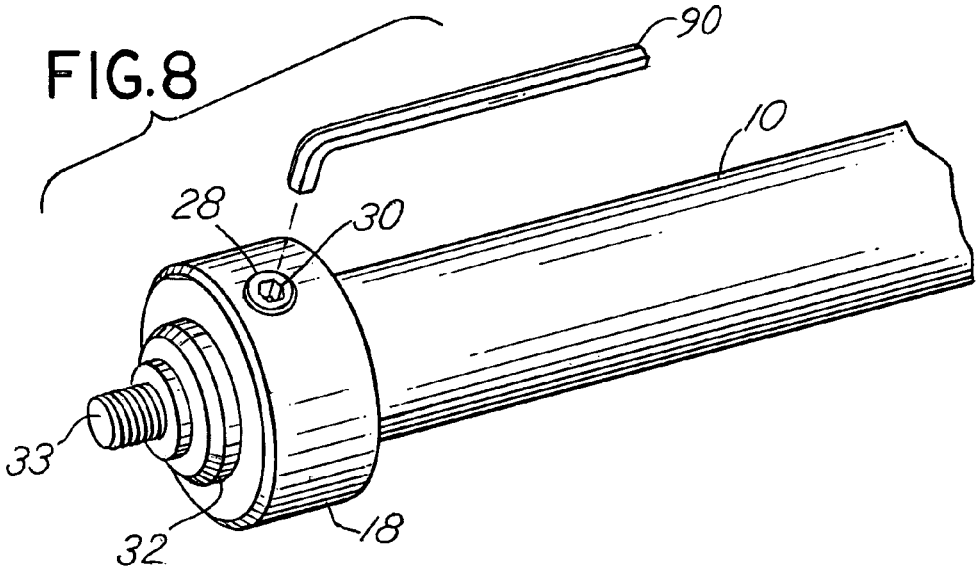

TIE ROD REMOVAL AND INSTALLATION TOOL

BACKGROUND OF THE INVENTION

This invention relates to an improved inner tie rod tool useful for removal and replacement of inner tie rods, particularly of the type which include a cylindrical inner end.

U.S. Pat. No. 5,287,776 for an Inner Tie Rod Tool, incorporated herewith by reference, discloses a tool to facilitate the removal and replacement of inner tie rods for the steering control system of a vehicle. That is, many vehicles are equipped with a rack and pinion steering control system which is connected by means of tie rods to the running gear for the front wheels of the vehicle. The steering wheel of the vehicle may thus be turned or rotated to effect rotation of a pinion, thereby driving a rack and consequently moving the tie rods to effect movement of the front wheels of the vehicle and thereby control the direction of vehicle movement.

Servicing and repair of the steering control system often requires removal and replacement of the tie rods, including the inner tie rods which effectively connect the rack or other steering mechanism to the front wheels of the vehicle. The tie rods typically include a rod with a collar at one end. The collar may include an internal threaded connection for attachment of the tie rod to the steering system and external flats for engagement by a wrench type tool to rotate the tie rod for removal or installation. U.S. Pat. No. 5,287,776 describes, in general, various types of tie rod constructions of this type and a tool for effecting their removal.

With some vehicle steering systems, the utilization of a hexagonal nut or flats associated with the collar of the inner tie rod are omitted and in their place the tie rod is provided with a cylindrical collar. Removal of the inner tie rod using a tool of the type disclosed in U.S. Pat. No. 5,287,776, thus becomes difficult and perhaps impractical.

Various solutions for removal of such alternative tie rod constructions have been proposed. For example, KD Tools makes an inner tie rod tool, Model 3312, designed for removal and installation of inner tie rods on many General Motors and some Chrysler products. This tool is designed to be used on tie rods having a complete hexagonal or just two flats on the inner end. The tool includes an annular end collar which is generally cylindrical and a single set screw. Northstar Manufacturing Company makes a similar product, part number 88-7301 identified as a universal inner tie rod socket. It utilizes a collar which engages the end of a tie rod by a pair of set screws.

Thus, the variety of tools available for the removal and replacement of inner tie rods is significant. Nonetheless, such tools are not necessarily satisfactory for removal of tie rods having round or cylindrical ends because such tie rods do not have any flat surfaces that can be engaged to facilitate their removal and replacement by wrench type devices. For example, the KD Tool described utilizes a large annular collar and single set screw in order to be compatible with numerous types of inner tie rods. Because of the size of the annular collar, the tool may be off center during use, thereby resulting in difficulty when seeking to effect tie rod removal inasmuch as the tool is not concentric with respect to the tie rod that is to be removed. This failure in alignment may cause parts to bind, for example.

Thus, there has developed the need to develop an inner tie rod tool especially useful for removal of tie rods wherein the tie rods do not necessarily include a flat end wrench engageable surface and wherein the tie rods typically would include a cylindrical or round end surface.

SUMMARY OF THE INVENTION

Briefly, the present invention comprises a tool for removal and replacement of inner tie rods which have a generally cylindrical end. The tool includes an elongate, hollow, cylindrical tube having a generally uniform internal diameter. A butt plate with a socket drive opening is attached at a first end of the tube for driving by means of a socket wrench. An annular collar is attached to the opposite end of the tube. The annular collar includes at least three radial threaded passages, each receiving a single headless set screw. The passages are arrayed at approximately 45° from each other. The location or array of the fastening passages and fasteners in combination with the annular collar enable placement of the tool upon tie rods having cylindrical outer engagement surfaces and enables generally concentric arrangement of the tool on the tie rod and facilitates ease of removal of such inner tie rods.

Thus, it is an object of the invention to provide an improved inner tie rod removal tool;

It is a further object of the invention to provide a tool for removal of inner tie rods having a generally cylindrical inner end;

Another object of the invention is to provide inexpensive yet highly efficient, inexpensive and easy to use inner tie rod removal tool.

These and other objects, advantages and features of the invention will be set forth in the detailed description which follows.

BRIEF DESCRIPTION OF THE DRAWING

In the detailed description which follows, reference will be made to the drawing comprised of the following figures:

FIG. 1 is an isometric view of an embodiment of the inner tie rod tool of the invention;

FIG. 2 is an exploded side plan view of the inner tie rod tool of FIG. 1;

FIG. 3 is an end view of the collar of the tie rod tool of FIG. 1;

FIG. 4 is a side view of the collar of FIG. 3;

FIG. 5 is an end view of the tool of FIG. 1 as viewed from the butt plate end;

FIG. 6 is a side cross sectional view of the tool of FIG. 1;

FIG. 7 is an isometric view of the tool of FIG. 1 placed over an inner tie rod having a cylindrical inner end; and FIG. 8 is an isometric view of the inner tie rod tool of FIG. 7 attached to the inner end of a tie rod.

DESCRIPTION OF THE PREFERRED EMBODIMENT

Referring to the Figures, the tool of the present invention is comprised of three basic parts that are assembled or welded together for use in combination with a set of three headless, set screws. Thus, the tool includes a generally cylindrical tube 10 having a longitudinal axis 12, a length in the axial direction in a range of twelve to twenty five inches and a cylindrical diameter in the range of one and one half to two inches. A typical axial dimension of such a tube is approximately thirteen inches. A butt plate 14 is welded at one end of the tube 10. The butt plate 14 includes a polygonal socket opening 16 aligned axially on the tube 10.

The opposite end of the tube 10 includes a cylindrical annular collar 18 welded thereto. The annular collar 18 includes three set screw threaded passages 20, 22 and 24, arranged radially and extending through the collar 18. The collar 18 thus includes a cylindrical passage 26 with the set screw passages 20, 22 and 24 extending from the outside face of the collar 18 to the interior passage 26. Threaded set screws such as set screw 28, which are headless and which include a polygonal recess 30 for receipt of an Allen wrench, for example, are threadably inserted into the separate threaded passageways 20, 22 and 24.

In the preferred embodiment, the internal diameter of the passageway 26 of the collar 18 is matched closely to the outer cylindrical dimension of the cylindrical end 32 of the tie rod 33 which is to be engaged, for example, as depicted in FIG. 7. The collar 18, tube 10 and butt plate 14 are thus all aligned co-axially and the tool can therefore be placed over the inner tie rod 33 of a vehicle with the collar 18 positioned over the cylindrical end 32 of the tie rod 33 so that the set screws, such as set screw 28, can be tightened against the outer surface of the cylindrical end 32 of inner tie rod 33.

As depicted in FIG. 4, the collar 18 includes a through passage 26 which is comprised of a first inner end counterbore 27 connected to an opposite end counterbore 29 to define the throughbore or passage 26. The inner end counterbore 27 diameter is closely matched to the outer diameter of the tube 10 and is greater than the diameter of the inner end counterbore 29. Thus, there is a transition or junction or ridge 31 connecting the counterbores 27 and 29. The ridge 31 limits the distance of insertion of the tube 10 into the collar 18 and precludes the tube 10 from being positioned inwardly in a manner that would interfere with the set screw passages 20, 22 and 24. Thus, the set screw passages 20, 22 and 24 each are directed radially into a portion of the inside counter bore 29.

The diameter of the inner counterbore 29 is closely matched to the outside diameter of the cylindrical end 32 of the tie rod 33. It exceeds the outside diameter thereof, but is closely matched so that it can slide thereon, enabling the set screws 28 to be tightened against the outer end of the tie rod 33 in a manner whereby the tool remains generally co-axial with the tie rod.

As another feature of the invention, the set screws 28 are arrayed at approximately 45° from one another within a cumulative range of about 90° maximum spacing of the screws 28. In this manner, the three set screws in combination, provide a tight grip on the tie rod 33 and simultaneously are positioned in a manner which will enable a mechanic to easily access those screws 28. Thus, the set screws 28 are not opposite of each other. Rather, they are within an approximate 90° section of the cylindrical collar 18.

These dimensional features and characteristics enable a mechanic or tradesman adequate benefit from the use of the tool in confined spaces where inner tie rods are located in motor vehicles. Thus, in the preferred embodiment, the passages or threaded openings for the set screws 28 are arranged at spaced angular relationship of 45°±5°, preferably. Also, the set screws 28 are headless in order to enable the screws 28 to be threaded into the appropriate passageways without limiting their radial inward movement and without projecting unnecessarily outwardly from the collar 18 and so as to enable an Allen wrench 90 access to the set screws. FIG. 8 depicts a typical Allen wrench 90 that would be used with the set screws that are contemplated with respect to the tool.

Variations of the tool are considered to be within the scope of the invention, including the dimensional variations associated with the component parts, the shape of the polygonal opening in the butt plate and other similar variations. The invention is therefore limited only by the following claims and equivalents thereof.

What is claimed is:

1. A tool for removal of inner tie rods having a generally cylindrical inner end, said tool comprising, in combination:

an elongate, hollow cylindrical tube having a center axis of rotation, a generally uniform internal diameter, a first butt end and a second tie rod engagement end;

a separate butt plate attached to the butt end with a polygonal socket co-axial with said tube;

a separate annular collar attached to and extending from the tie rod engagement end of the hollow tube co-axial with the tube, said collar having a cylindrical throughbore formed by a first counterbore of lesser diameter than the outer diameter of the hollow tube, said first counterbore connected to a second cylindrical counterbore of greater diameter than the outer diameter of the hollow tube, said hollow tube fitted into the second cylindrical counterbore and attached to the collar, said portion of said collar extending from said tube including three generally identical radial, threaded, through passages extending outwardly from the first counterbore, said passages forming an array spaced 45°±5° generally equally apart; and a generally identical headless set screw in each passage.

2. The tool of claim 1 wherein the passages are spaced approximately 45°.

3. The tool of claim 1 further including an Allen wrench compatible with the set screws.

* * * * *